US009301630B2

(12) United States Patent
Guo

(10) Patent No.: US 9,301,630 B2
(45) Date of Patent: Apr. 5, 2016

(54) COMPOSITE CUP STRUCTURE

(71) Applicant: Tzer-Huang Guo, Keelung (TW)

(72) Inventor: Tzer-Huang Guo, Keelung (TW)

( * ) Notice: Subject to any disclaimer, the term of this patent is extended or adjusted under 35 U.S.C. 154(b) by 36 days.

(21) Appl. No.: 13/892,220

(22) Filed: May 10, 2013

(65) Prior Publication Data

US 2014/0332541 A1 Nov. 13, 2014

(51) Int. Cl.

| | |
|---|---|
| ***A47G 19/22*** | (2006.01) |
| ***B65D 25/34*** | (2006.01) |
| ***B65D 3/22*** | (2006.01) |

(52) U.S. Cl.

CPC ..... *A47G 19/2288* (2013.01); *B65D 3/22* (2013.01); *B65D 25/34* (2013.01)

(58) Field of Classification Search

CPC ..... B65D 3/00; B65D 3/22; B65D 81/3813; B65D 81/3816; B65D 81/3818; B65D 81/3823; B65D 81/3837; B65D 81/3839; B65D 81/3841; B65D 81/3846; B65D 81/3865; B65D 81/3867; B65D 81/3869; B65D 81/3874; B65D 81/3876; B65D 81/3879; B65D 81/3881; B65D 81/3886; A47G 19/22; A47G 19/2288

USPC ..... 220/592.17, 592.2, 592.24, 592.25, 220/592.26; 229/400, 403, 405

See application file for complete search history.

(56) References Cited

U.S. PATENT DOCUMENTS

| | | | | |
|---|---|---|---|---|
| 8,490,792 | B2 * | 7/2013 | D'Amato | 206/459.5 |
| 2005/0115975 | A1 * | 6/2005 | Smith et al. | 220/592.17 |
| 2012/0318805 | A1 * | 12/2012 | Leser et al. | 220/592.17 |
| 2014/0209618 | A1 * | 7/2014 | Slack | 220/592.2 |

* cited by examiner

*Primary Examiner* — Steven A. Reynolds
*Assistant Examiner* — Javier A Pagan

(57) ABSTRACT

An improved composite cup structure, which comprising: an inner plastic cup and an outer paper cup; of which the composite cup is manufactured from paper and plastics by a ratio of 7:3; the rims of both inner plastic cup and outer paper cup are provided with outwards curled edges, in particular, the curled edge of the inner plastic cup is slightly larger than that of the outer paper cup, and a flat surface is formed on the top; besides, an extension sheet of any shape is formed on the curled edge towards the cup bottom; when the inner and outer cups are overlapped, the curled edge of the inner plastic cup could cover the curled edge of the outer paper cup, thus forming a heat-insulating, leak-proofing composite cup of excellent strength; the extension sheet contributes to the separation of inner and outer cups for classification and recycling.

19 Claims, 9 Drawing Sheets

COMPOSITE CUP STRUCTURE

BACKGROUND OF INVENTION

1. Field of the Invention

The present invention relates generally to an improved paper container, and more particularly to an innovative one which is designed with detachable inner and outer cups of good strength, excellent heat insulation and leakage resistance.

2. Description of Related Art

A disposable liquid container is generally made of plastics and paper materials. Of which, the plastic container of a single-layer structure is not suited for heat insulation despite of its advantages such as: ease of manufacturing, lower cost and better leakproofing; the paper container is manufactured with more complex procedures and higher cost, but its leakproofing effect and structural strength are inferior to the plastic container; so multi-layer or thickening design is required for desired heat insulation, or foamed heat-insulating layers are combined, leading to extremely high cost.

SUMMARY OF THE INVENTION

The primary objective of the present invention is to provide an improved composite cup structure, which allows to combine a plastic film with an outer paper cup for detachable and recyclable applications by using the extension sheet formed by the curled edge of the cup rim.

The second objective of the present invention is to provide an improved composite cup structure, which permits to accommodate a foamed heat-insulating layer for the desired heat insulation effect by a holding space formed by the gap of inner and outer cups.

The third objective of the present invention is to provide an improved composite cup structure, which enables various kinds of opening designs around the body of outer paper cup, making it helpful for marketing without affecting the airtightness and integrity.

The fourth objective of the present invention is to provide an improved composite cup structure, which is manufactured from recycled paper and plastics by a ratio of 7:3, contributing to environmental protection and cost effectiveness.

The present invention proposes a novel composite cup has been designed, which comprising: an inner plastic cup and an outer paper cup; the rims of both inner plastic cup and outer paper cup are provided with outwards curled edges, in particular: the curled edge of the inner plastic cup is slightly larger than that of the outer paper cup, and a flat surface is formed on the top; besides, an extension sheet of any shape is formed on the curled edge towards the cup bottom; when the inner and outer cups are overlapped, the curled edge of the inner plastic cup could cover the curled edge of the outer paper cup, thus forming a leakproofing composite cup of excellent strength; the extension sheet contributes to the separation of inner and outer cups for classification and recycling.

Of which, the extension sheet on the curled edge of the inner plastic cup could be formed into various geometric shapes, such as: water droplet, convex, round, polygonal and rectangular; various forms of openings could be designed around the body of outer paper cup, such as: oval, banded, diamond-shaped, rectangular, round and straight.

Moreover, a heat-insulating layer is set between the inner plastic cup and outer paper cup of said composite cup; the heat-insulating layer is a plastic-foamed layer formed around the body of inner plastic cup with the same materials; after inner and outer cups are overlapped, a heat-insulating, leakproofing composite cup of excellent strength without condensation on the external surface could be formed.

DETAILED DESCRIPTION OF THE PREFERRED EMBODIMENT

Figure 1:
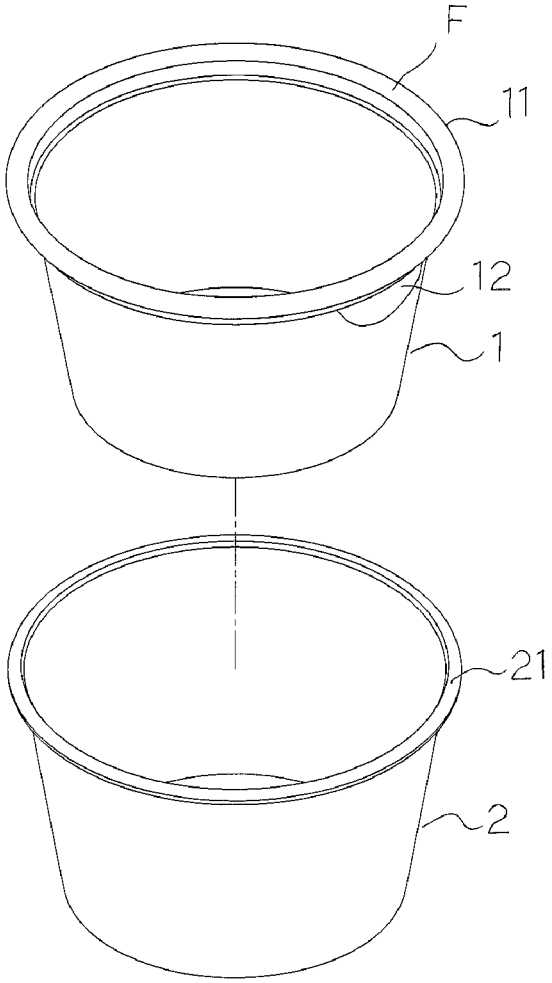
FIG. 1: an exploded view of composite cup in a preferred embodiment of the present invention.
Figure 2:
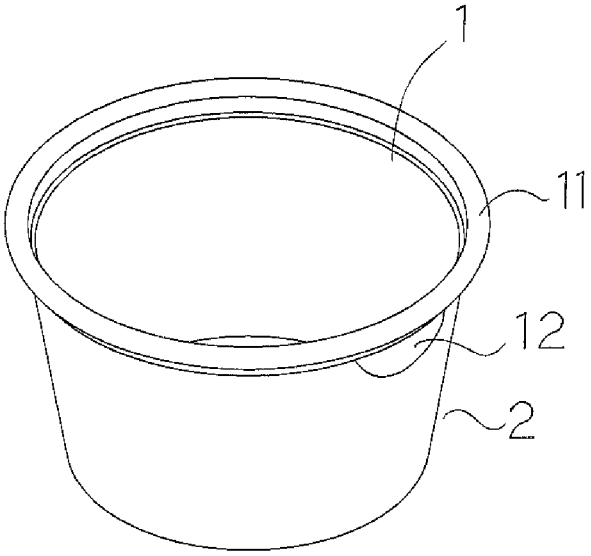
FIG. 2: an assembled view of composite cup in a preferred embodiment of the present invention.
Figure 3:
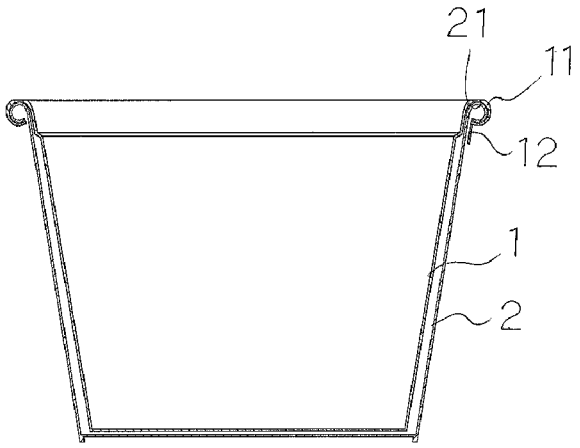
FIG. 3: an assembled sectional view of composite cup in a preferred embodiment of the present invention.

Referring to FIGS. 1~3, the improved composite cup structure of the present invention comprises: an inner plastic cup 1 and an outer paper cup 2, with a ratio of paper and plastic of 7:3 (i.e.: weight percentage 70%:30%); hence the outer paper cup 2 presents stronger structural strength for convenient printing and marketing; secondly, recycled paper could be adopted in consideration of environmental protection and cost effectiveness; meanwhile, the plastic inner cup in contact with the objects could eliminate the concern on food sanitation or safety.

About the construction of the composite cup, the rims of both inner plastic cup 1 and outer paper cup 2 are provided with outwards curled edges 11, 21; the curled edge 11 of the inner plastic cup 1 is slightly larger than the curled edge 21 of the outer paper cup 2, and a flat surface F is formed on the top; so packaging requiring for heat sealability has a higher airtightness to ensure that the sealed objects are fully isolated from air without oxydation; and an extension sheet 12 of any geometric shape is formed on the curled edge 11 towards the cup bottom, as shown in FIG. 2.

The inner plastic cup 1 is made of PP (Polypropylene), PS (Polystyrene), PLA (Polylactide,), PE (Polyethylene) or PET (Polyethylene Terephthalate).

During assembly of said composite cup, the curled edge 11 of the inner plastic cup 1 is spread, then the outer paper cup 2 is sleeved onto the inner plastic cup 1, such that the curled edge 11 of the inner plastic cup 1 could cover the curled edge 21 of the outer paper cup 2; after overlapping, the inner plastic cup 1 could eliminate the concern of possible leakage, forming a heat-insulating, leakproofing composite cup of excellent strength without condensation, as shown in FIG. 3.

The outer paper cup 2 of the composite cup could be suited for printing and marketing due to excellent structural strength.

When it is intended to separate the composite cup, the extension sheet 12 on the curled edge 11 of the inner plastic cup 1 could be pulled up such that the inner plastic cup 1 and the outer paper cup 2 are separated for independent use.

The composite cup of the present invention is manufactured directly by two containers of different materials, without need of any glue or adhesive. Upon completion of assembly of the container with better structure and functionality, the extension sheet 12 is used to separate easily the inner plastic cup 1 and outer paper cup 2 for subsequent classification and recycling.

Figure 4:
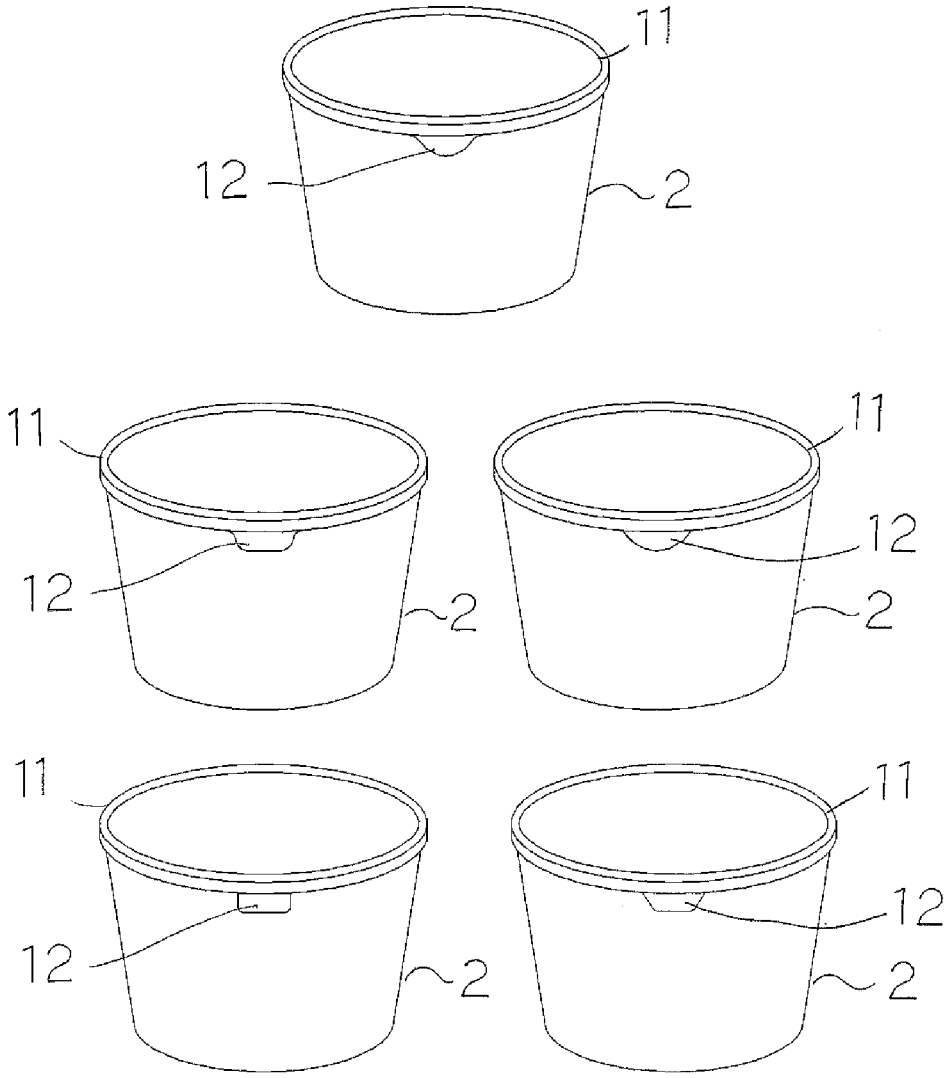
FIG. 4: a view of composite cup in a preferred embodiment of the present invention that various shapes of extension sheets are formed on the curled edge of the inner cup.
Figure 5:
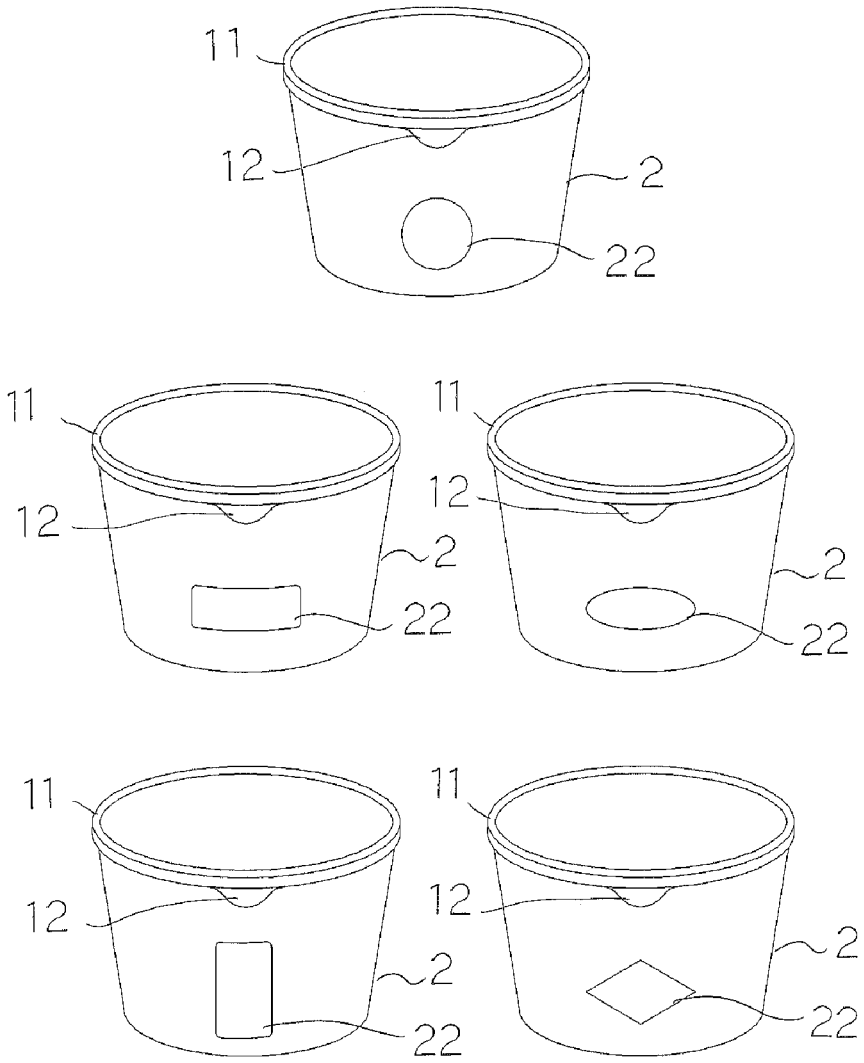
FIG. 5: a view of composite cup in a preferred embodiment of the present invention that various shapes of openings are formed around the body of the outer cup.

Referring also to FIGS. 4, 5, the extension sheet 12 on the curled edge 11 of the inner plastic cup 1 could be formed into various geometric shapes, such as: water droplet, convex, round, polygonal and rectangular; various forms of openings 22 could be designed around the body of outer paper cup 2, such as: oval, banded, diamond-shaped, rectangular, round and straight. This allows you to visualize the objects in the inner plastic cup 1 and promote the marketing without affecting its airtightness and integrity.

Figure 6:
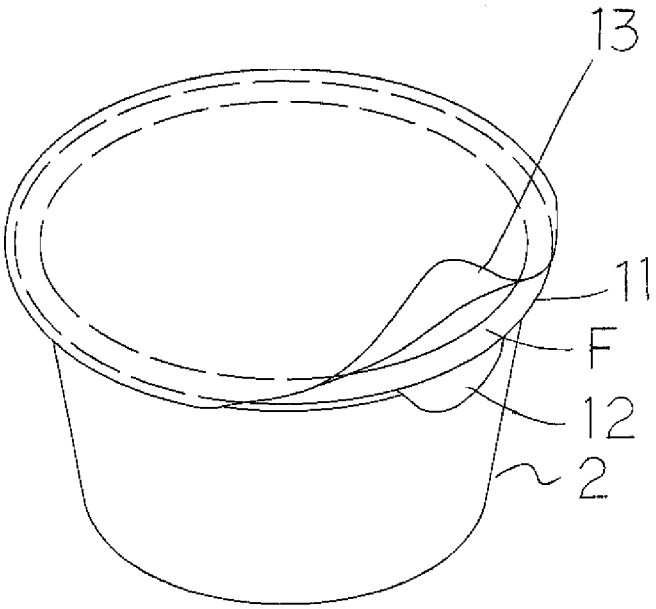
FIG. 6: an assembled view of composite cup in another preferred embodiment of the present invention.
Figure 7:
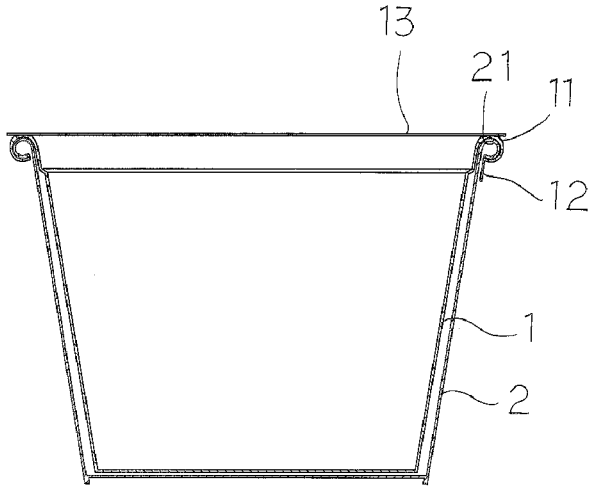
FIG. 7: an assembled sectional view of composite cup in another preferred embodiment of the present invention.

Referring also to FIGS. 6, 7, when the objects in the composite cup need to be sealed, the curled edge 11 on the rim of the inner plastic cup 1 is sealed with adhesive film 13, and a flat surface F is designed on the top of the curled edge 11; so with the help of more excellent heat-sealing procedures, the sealed objects are fully isolated from air without oxydation.

Figure 8:
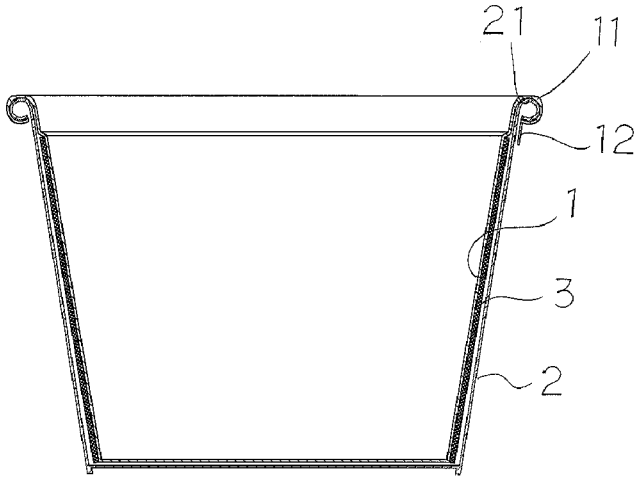
FIG. 8: an assembled sectional view of composite cup in another preferred embodiment of the present invention.

Referring to FIG. 8, a heat-insulating layer 3 is set between the inner plastic cup 1 and outer paper cup 2 of said composite cup; the heat-insulating layer 3 is a plastic-foamed layer formed around the body of inner plastic cup 1 with the same materials; after inner and outer cups are overlapped, a heat-insulating, leakproofing composite cup of excellent strength without condensation on the external surface could be formed.

Figure 9:
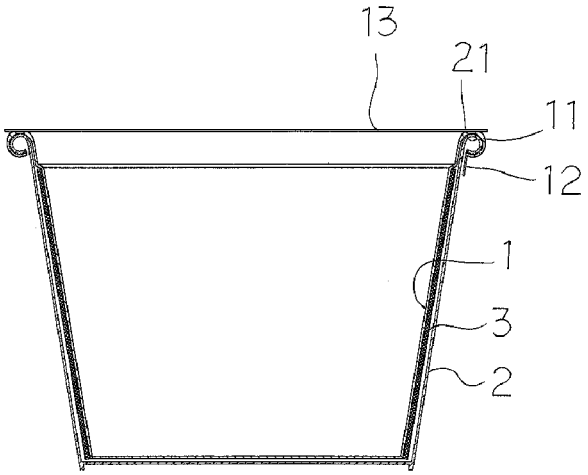
FIG. 9: another structural view of composite cup in another preferred embodiment of the present invention.

Referring also to FIG. 9, when the objects in the composite cup need to be sealed, the curled edge 11 on the rim of the inner plastic cup 1 is sealed with adhesive film, so the sealed objects are fully isolated from air without oxydation.

With the preferred embodiment as described above, the present invention aims to achieve the following goals:

1. The inner and outer cups are assembled by different materials, without need of any glue or adhesive.
2. The extension sheet of the composite cup is used to separate easily the inner and outer cups for subsequent classification and recycling.
3. The outer paper cup presents stronger structural strength for convenient printing and marketing.
4. The materials and molding pattern of the inner plastic cup could eliminate the concern of possible leakage.
5. A flat surface is designed on the top of the curled edge of the inner cup; so with the help of more excellent heat-sealing procedures, the sealed objects are fully isolated from air without oxydation.
6. The extension sheets of the inner plastic cup allow to separate easily the inner and outer cups without affecting its airtightness and strength.
7. Various forms of openings could be designed around the body of outer paper cup, helping to promote the marketing without affecting its airtightness and integrity.
8. The composite cup is manufactured by paper and plastics with a ratio of 7:3, and recycled paper could be adopted in consideration of environmental protection and cost effectiveness; meanwhile, the plastic inner cup in contact with the objects could eliminate the concern on food sanitation or safety.

The invention claimed is:

1. A composite cup comprising,
an inner plastic cup, comprising,
a first cup body,
a first cup bottom disposed at the bottom of the first cup body,
a first rim disposed at the top of the first cup body, and
a first outwards curled edge disposed around the first rim; and
an outer paper cup, configured to be sleeved onto the inner plastic cup and comprising,
a second cup body,
a second cup bottom disposed at the bottom of the second cup body,
a second rim disposed at the top of the second cup body,
a second outwards curled edge disposed around the second rim, wherein the first outwards curled edge covers the second outwards curled edge, and has a flat top surface, and
an extension sheet extending from the first curled edge towards the cup bottom, wherein during a separation process, a user separates the inner plastic cup from the outer paper cup by pulling up the extension sheet in a direction that is away from the cup bottom with the extension sheet still attached to the inner plastic cup, such that the inner plastic cup and the outer paper cup are separated for independent use.

2. The composite cup as claimed in claim 1, wherein the extension sheet has the shape of water droplet, or the convex, rounded, polygonal, or rectangular shape.

3. The composite cup as claimed in claim 1, wherein said outer paper cup's body has one or more openings, wherein said inner plastic cup allows the user to visualize an object contained inside said inner plastic cup through the one or more openings while maintaining the airtightness and integrity of said inner plastic cup.

4. The composite cup as claimed in claim 1, wherein the inner plastic cup is made of PP (Polypropylene), PS (Polystyrene), PLA (Polylactide), PE (Polyethylene) or PET (Polyethylene Terephthalate).

5. The composite cup as claimed in claim 1, further comprising an adhesive film sealed over the upper opening of the composite cup.

6. The composite cup as claimed in claim 1, further comprising a plastic foamed heat-insulating layer disposed between the first cup body and the second cup body.

7. The composite cup as claimed in claim 6, wherein the plastic foamed heat-insulating layer and inner plastic cup are made of the same material.

8. The composite cup as claimed in claim 1, wherein the weight ratio between the outer paper cup and the inner paper cup is 7:3.

9. The composite cup as claimed in claim 1, wherein the outer paper cup is made of recycled paper.

10. The composite cup as claimed in claim 1, wherein the inner plastic cup and the outer paper cup are not bonded with any glue or adhesive.

11. A composite cup comprising,
an inner plastic cup, comprising,
a first cup body,
a first cup bottom disposed at the bottom of the first cup body,
a first rim disposed at the top of the first cup body, and
a first outwards curled edge disposed around the first rim; and
an outer paper cup, configured to be sleeved onto the inner plastic cup and comprising,
a second cup body,
a second cup bottom disposed at the bottom of the second cup body,
a second rim disposed at the top of the second cup body,
a second outwards curled edge disposed around the second rim, wherein the first outwards curled edge covers the second outwards curled edge, and has a flat top surface, a plastic foamed heat-insulating layer disposed between the first cup body and the second cup body, and an extension sheet extending from the first curled edge towards the cup bottom, wherein during a separation process, a user separates the inner plastic cup from the outer paper cup by pulling up the extension sheet in a direction that is away from the cup bottom with the extension sheet still attached to the inner plastic cup, such that the inner plastic cup and the outer paper cup are separated for independent use.

12. The composite cup as claimed in claim 11, wherein the extension sheet has the shape of water droplet, or the convex, rounded, polygonal, or rectangular shape.

13. The composite cup as claimed in claim 11, wherein said outer paper cup's body has one or more openings, wherein said inner plastic cup allows the user to visualize an object contained inside said inner plastic cup through the one or more openings while maintaining the airtightness and integrity of said inner plastic cup.

14. The composite cup as claimed in claim 11, wherein the inner plastic cup is made of PP (Polypropylene), PS (Polystyrene), PLA (Polylactide), PE (Polyethylene) or PET (Polyethylene Terephthalate).

15. The composite cup as claimed in claim 11, further comprising an adhesive film sealed over the upper opening of the composite cup.

16. The composite cup as claimed in claim 11, wherein the plastic foamed heat-insulating layer and inner plastic cup are made of the same material.

17. The composite cup as claimed in claim 11, wherein the weight ratio between the outer paper cup and the inner paper cup is 7:3.

18. The composite cup as claimed in claim 11, wherein the outer paper cup is made of recycled paper.

19. The composite cup as claimed in claim 11, wherein the inner plastic cup and the outer paper cup are not bonded with any glue or adhesive.

* * * * *